US011219795B1

(12) United States Patent
Yao

(10) Patent No.: US 11,219,795 B1
(45) Date of Patent: Jan. 11, 2022

(54) ELECTRONICALLY CONTROLLED ADJUSTABLE DUMBBELL

(71) Applicant: Chengjin Yao, Qingdao (CN)

(72) Inventor: Chengjin Yao, Qingdao (CN)

( * ) Notice: Subject to any disclaimer, the term of this patent is extended or adjusted under 35 U.S.C. 154(b) by 0 days.

(21) Appl. No.: 17/392,393

(22) Filed: Aug. 3, 2021

(51) Int. Cl.

| | |
|---|---|
| ***A63B 21/075*** | (2006.01) |
| ***A63B 24/00*** | (2006.01) |
| ***A63B 21/072*** | (2006.01) |
| ***A63B 71/06*** | (2006.01) |

(52) U.S. Cl.
CPC ..... *A63B 21/075* (2013.01); *A63B 21/0726* (2013.01); *A63B 21/0728* (2013.01); *A63B 24/0087* (2013.01); *A63B 71/0619* (2013.01); *A63B 2071/0658* (2013.01)

(58) Field of Classification Search
CPC ..... A63B 21/075; A63B 21/0726; A63B 71/0619; A63B 21/0728; A63B 24/0087; A63B 2071/0658; A63B 21/072; A63B 21/0722; A63B 21/0724; A63B 21/06–075; A63B 2017/0658
See application file for complete search history.

(56) References Cited

U.S. PATENT DOCUMENTS

| | | | | |
|---|---|---|---|---|
| 2009/0197745 | A1* | 8/2009 | Olson | A63B 21/0728 482/107 |
| 2012/0295774 | A1* | 11/2012 | Dalebout | A63B 21/0726 482/106 |
| 2020/0114204 | A1* | 4/2020 | Owusu | A63B 21/075 |
| 2020/0376320 | A1* | 12/2020 | Wang | A63B 21/075 |
| 2021/0154519 | A1* | 5/2021 | Chen | A63B 21/0728 |

* cited by examiner

*Primary Examiner* — Joshua Lee
*Assistant Examiner* — Catrina A Letterman
(74) *Attorney, Agent, or Firm* — Sandy Lipkin

(57) ABSTRACT

The invention discloses an electronically controlled adjustable dumbbell comprising a handle grip, a weight stack, a base, an end cover, an electronic control system and a weight stack locking structure, wherein the weight stack is located below the handle grip. The invention solves the existing problems of adjustable dumbbells as follows: firstly, the operation is so complicated and cumbersome that it is quite difficult to adjust the weight in one try, and the novice who is new to the adjustable dumbbells cannot quickly adjust the weight plate; secondly, visually the product looks too complicated since the number that needs to be adjusted is printed on the cylindrical surface, and half of the numbers on the handle surface are located below the handle grip, which is difficult to see by the user; thirdly, the lack of modernity and inadequate aesthetics hinders product sales and makes it difficult to make profit quickly.

9 Claims, 7 Drawing Sheets

ELECTRONICALLY CONTROLLED ADJUSTABLE DUMBBELL

FIELD OF THE DISCLOSURE

The invention relates to the technical field of physical training devices, and in particular to an electronically controlled adjustable dumbbell.

BACKGROUND OF THE DISCLOSURE

Adjustable dumbbell is a kind of physical training device, and at present, has the following problems: firstly, the operation is so complicated and cumbersome that it is quite difficult to adjust the weight in one try, and the novice who is new to the adjustable dumbbells cannot quickly adjust the weight plate, resulting in wrong operation and unsuccessful weight plate adjustment, and even causing damage to the product in some cases and inconvenience to the users; secondly, visually the product looks too complicated since the number that needs to be adjusted is printed on the cylindrical surface, and half of the numbers on the handle surface are located below the handle grip, which is difficult to see by the user; thirdly, the lack of modernity and inadequate aesthetics hinders product sales, making it difficult to make profit quickly.

SUMMARY OF THE DISCLOSURE

In order to solve the above-mentioned problems in the background technology, the invention aims to provide an electronically controlled adjustable dumbbell that has the advantage of electronic control and solves the following problems of existing adjustable dumbbell: firstly, the operation is so complicated and cumbersome that it is quite difficult to adjust the weight in one try, and the novice who is new to the adjustable dumbbells cannot quickly adjust the weight plate, resulting in wrong operation and unsuccessful weight plate adjustment, and even causing damage to the product in some cases and inconvenience to the users; secondly, visually the product looks too complicated since the number that needs to be adjusted is printed on the cylindrical surface, and half of the numbers on the handle surface are located below the handle grip, which is difficult to see by the user; thirdly, the lack of modernity and inadequate aesthetics hinders product sales and makes it difficult to make profit quickly.

To achieve the above objectives, the invention provides the following technical solutions: an electronically controlled adjustable dumbbell, comprising a handle grip, a weight stack, a base, an end cover, an electronic control system and a weight stack locking structure, wherein the weight stack is located below the handle grip, the base is located at the bottom of the weight stack, the end cap is fixed on the front and back of the handle grip by bolts, the electronic control system is positioned on the surface of handle grip, the electronic control system comprises an electronic screen, a main board, wires, a battery and a motor assembly, wherein the main board is fixed to the rear side on the top of handle grip; the electronic screen positioned on the top of the main board is electrically connected to the main board through wires, one end of the wire is fixed to the main board, and the other end connected to the battery, the motor is electrically connected to the main board through wires, and the electronic control system is connected to the weight stack locking structure, and the weight stack locking structure comprises a first locking bar, a rotating shaft, a second locking bar, a weight plate clamping block, and a weight plate spacer, wherein the first locking bar, rotating shaft, the second locking bar, the weight plate clamping block and weight plate spacer are all located inside the handle grip, and the first locking bar and the second locking bar are powered by the rotating shaft.

As a preferred embodiment of the invention, the front side and the back side of the top of the electronic screen are provided with a button switch.

As a preferred embodiment of the invention, the front of the main board is connected with a charging port.

As a preferred embodiment of the invention, the surface of the first locking bar is provided with spiral groove for the motor that works in conjunction with the rotating shaft and the second locking bar.

As a preferred embodiment of the invention, the motor assembly rotates with the first locking bar (14), and is connected with the weight stack locking structure for transmission.

As a preferred embodiment of the invention, ten weight plates are evenly positioned at the front and back side of the bottom of handle grip.

As a preferred embodiment of the invention, both the front and back side on the top of the base are provided with storage slots for the weight plates, and the top of base is provided with spacing slots which are located inside the storage slot and used in conjunction with the handle grip.

As a preferred embodiment of the invention, an electronic screen is installed on the rear side of the top of handle grip.

As a preferred embodiment of the invention, the motor assembly can be detached through screws and connected to the front and back of the handle grip, and the end cover is designed with a curved surface.

Compared with the prior art, the invention has the following technical benefits:

1. The invention provides a handle grip, a weight stack, a base, an end cover, an electronic control system and a weight stack locking structure, and solves the existing problems of adjustable dumbbells as follows: firstly, the operation is so complicated and cumbersome that it is quite difficult to adjust the weight in one try, and the novice who is new to the adjustable dumbbells cannot quickly adjust the weight plate, resulting in wrong operation and unsuccessful weight plate adjustment, and even causing damage to the product in some cases and inconvenience to the users; secondly, visually the product looks too complicated since the number that needs to be adjusted is printed on the cylindrical surface, and half of the numbers on the handle surface are located below the handle grip, which is difficult to see by the user; thirdly, the lack of modernity and inadequate aesthetics hinders product sales, making it difficult to make profit quickly. The electronically controlled adjustable dumbbell has the advantage of electronic control.

2. The invention provides a button switch so that the user can turn on or off the electronic control system and the screen can display the current weight of weight plates.

3. The invention provides a charging port so that the main board can be charged to maintain sufficient power.

4. The invention provides a spiral groove for the motor so that it can be operated in conjunction with the motor assembly, facilitating the motor assembly to drive the first and the second locking bar.

5. The invention provides a motor assembly, so that the user can control the rotation of motor through the electronic screen and main board, thereby locking the weight stack for weight plate adjustment.

Figure 1:
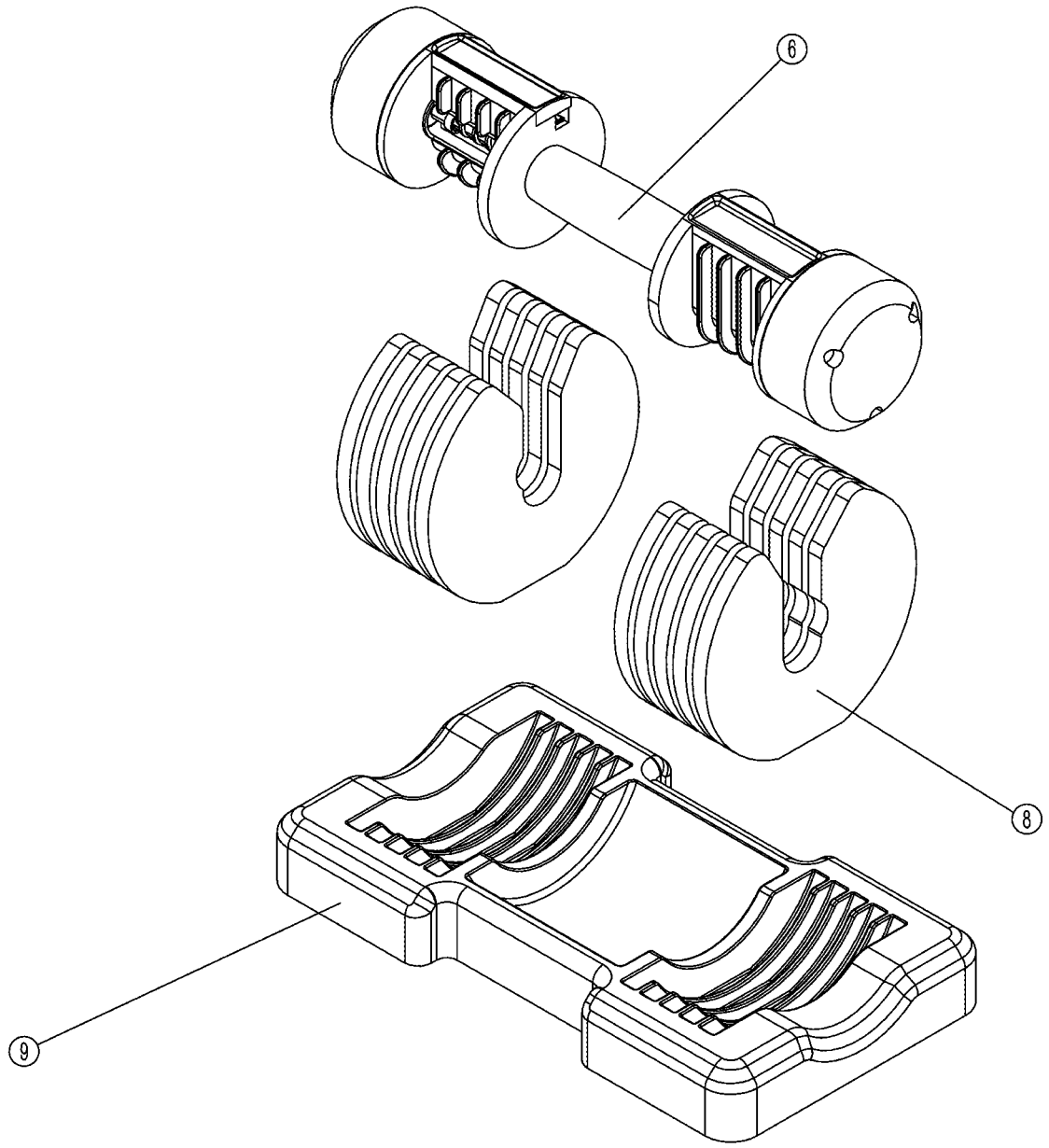
FIG. 1 is an exploded view of the structure of the invention.

Where: 1. Electronic screen; 2. Main board; 3. Wire; 4. Battery; 5. Motor assembly; 6. Handle grip; 7. End cover; 8. Weight stack; 9. Base; 10. Button switch 11. Charging port; 12. Weight plate spacer block; 13. Weight plate clamping block; 14. First locking bar; 15. Rotating shaft; 16. Second locking bar.

DETAILED DESCRIPTION OF THE EMBODIMENT

With reference to the figures in the embodiments of the invention, the technical solutions in the embodiments of the invention will be clearly and completely described below. Obviously, the described embodiments are only a part of, rather than all the embodiments, of the invention. Based on the embodiments of the invention, all other embodiments obtained by those of ordinary skill in the art without creative work shall fall within the protection scope of the invention.

As shown in FIGS. 1 to 7, the invention provides an electronically controlled adjustable dumbbell comprising a handle grip (6), a weight stack (8), a base (9), an end cover (7), an electronic control system and a weight stack locking structure, wherein the weight stack (8) is located below the handle grip (6), the base (9) is located at the bottom of the weight stack (8), the end cap (7) is fixed on the front and back of the handle grip (6) by bolts, and the electronic control system is positioned on the handle grip (6), the electronic control system comprises an electronic screen (1), a main board (2), wires (3), a battery (4) and a motor assembly (5), wherein the main board (2) is fixed to the rear side on the top of handle grip (6), the electronic screen (1) positioned on the top of the main board (2) is electrically connected to the main board (2) through wires, one end of the wire (3) is fixed to the main board (2), and the other end connected to the battery (4), the motor is electrically connected to the main board (2) through wires, and the electronic control system is connected to the weight stack locking structure, and the weight stack locking structure comprises a first locking bar (14), a rotating shaft (15), a second locking bar (16), a weight plate clamping block (13), and a weight plate spacer (12), wherein the first locking bar (14), rotating shaft (15), the second locking bar (16), the weight plate clamping block (13), and weight plate spacer (12) are all located inside the handle grip (6), the first locking bar (14) and the second locking bar (16) are powered by the rotating shaft (15).

Figure 4:
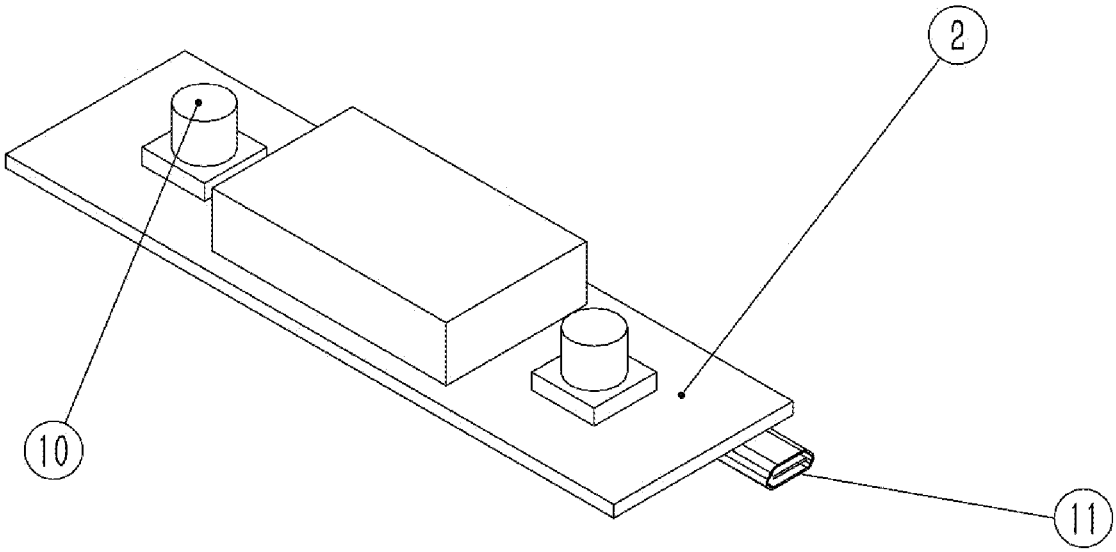
FIG. 4 is a perspective view of the main board of the invention.

As shown in FIG. 4, the front side and the back side of the top of the electronic screen (1) are provided with a button switch (10).

As a technical optimization scheme, the invention provides a button switch (10) so that the users can turn on or off the electronic control system and the screen can display the weight of weight plates.

As shown in FIG. 4, the front of the main board (2) is connected with the charging port (11);

As a technical optimization scheme, the invention provides a charging port 11 so that the main board 2 can be charged to maintain sufficient power.

Figure 5:
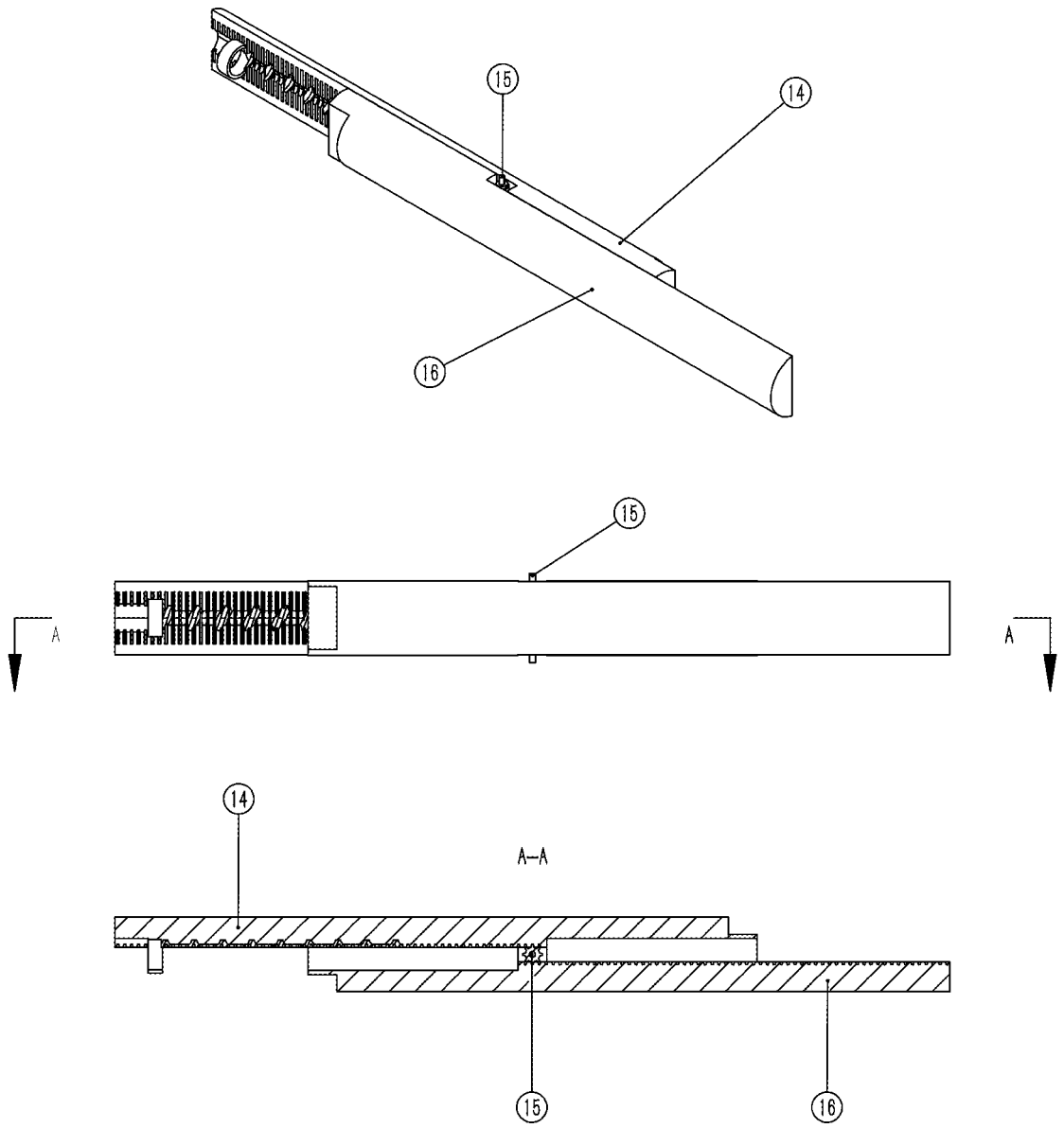
FIG. 5 is a perspective view and cross-sectional view of the first locking bar of the invention.

As shown in FIG. 5, the surface of the first locking bar (14) is provided with a spiral groove for the motor that works in conjunction with the rotating shaft (15) and the second locking bar (16).

As a technical optimization scheme, the invention provides a spiral groove for the motor so that it can be operated in conjunction with the motor assembly (5), facilitating the motor assembly (5) to drive the first (14) and the second locking bar (16).

Figure 6:
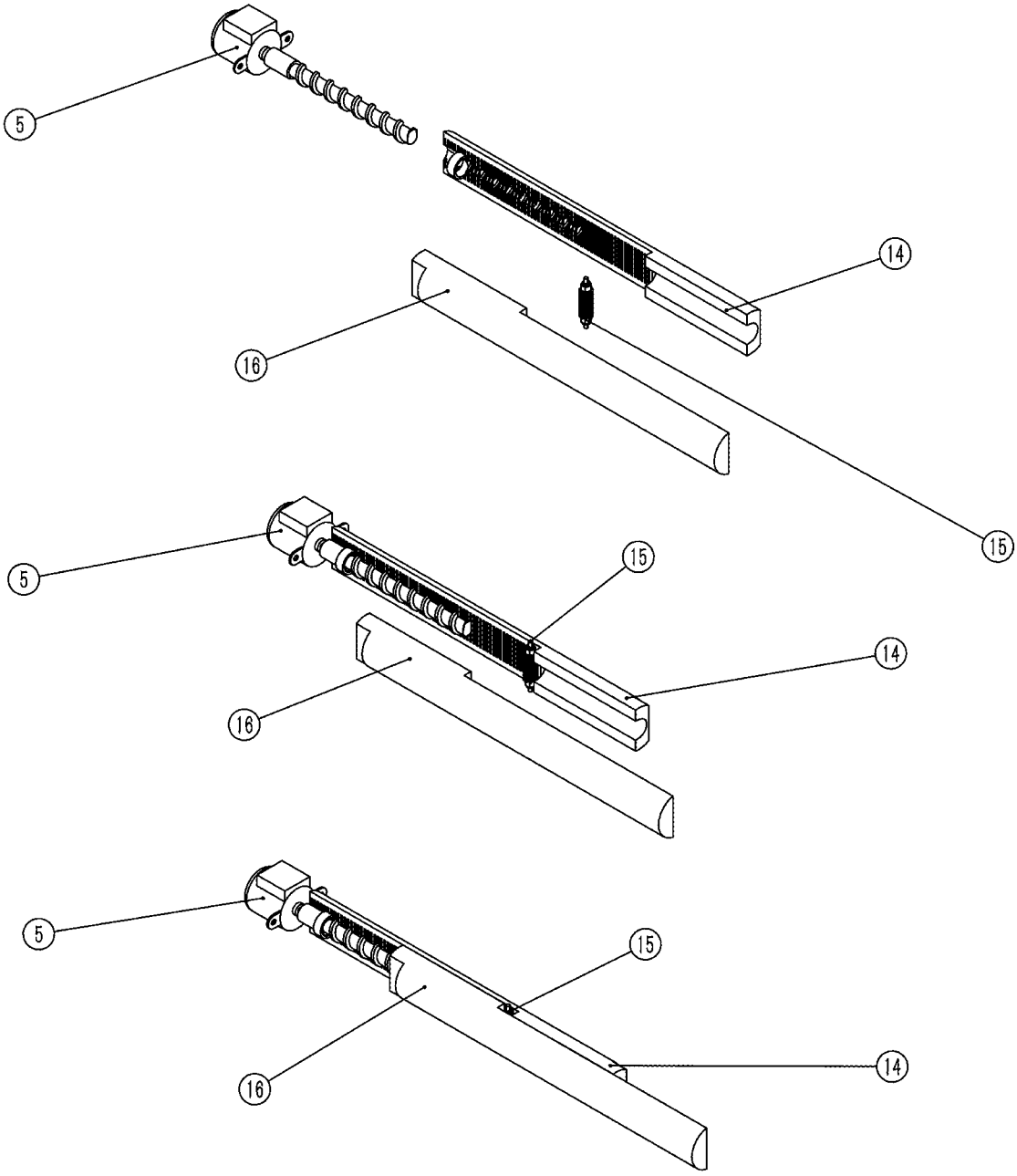
FIG. 6 is an exploded view of the connection of motor assembly of the invention.
Figure 7:
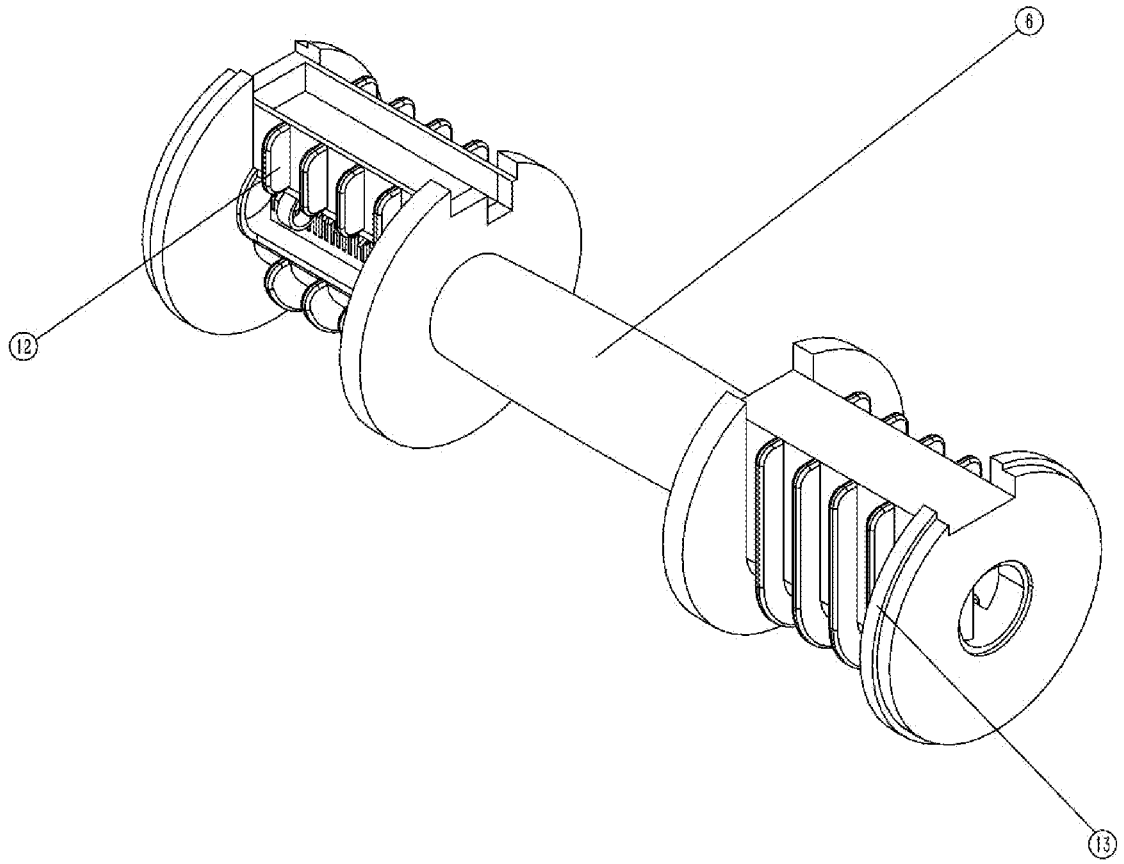
FIG. 7 is a perspective view of the handle grip of the invention.

As shown in FIG. 6, the motor assembly (5) rotates with the first locking bar (14), and is connected with the weight stack locking structure for transmission.

As a technical optimization scheme, the invention provides a motor assembly (5), so that the user can control the rotation of motor through the electronic screen (1) and main board (2), thereby locking the weight stack for weight plate adjustment.

Figure 2:
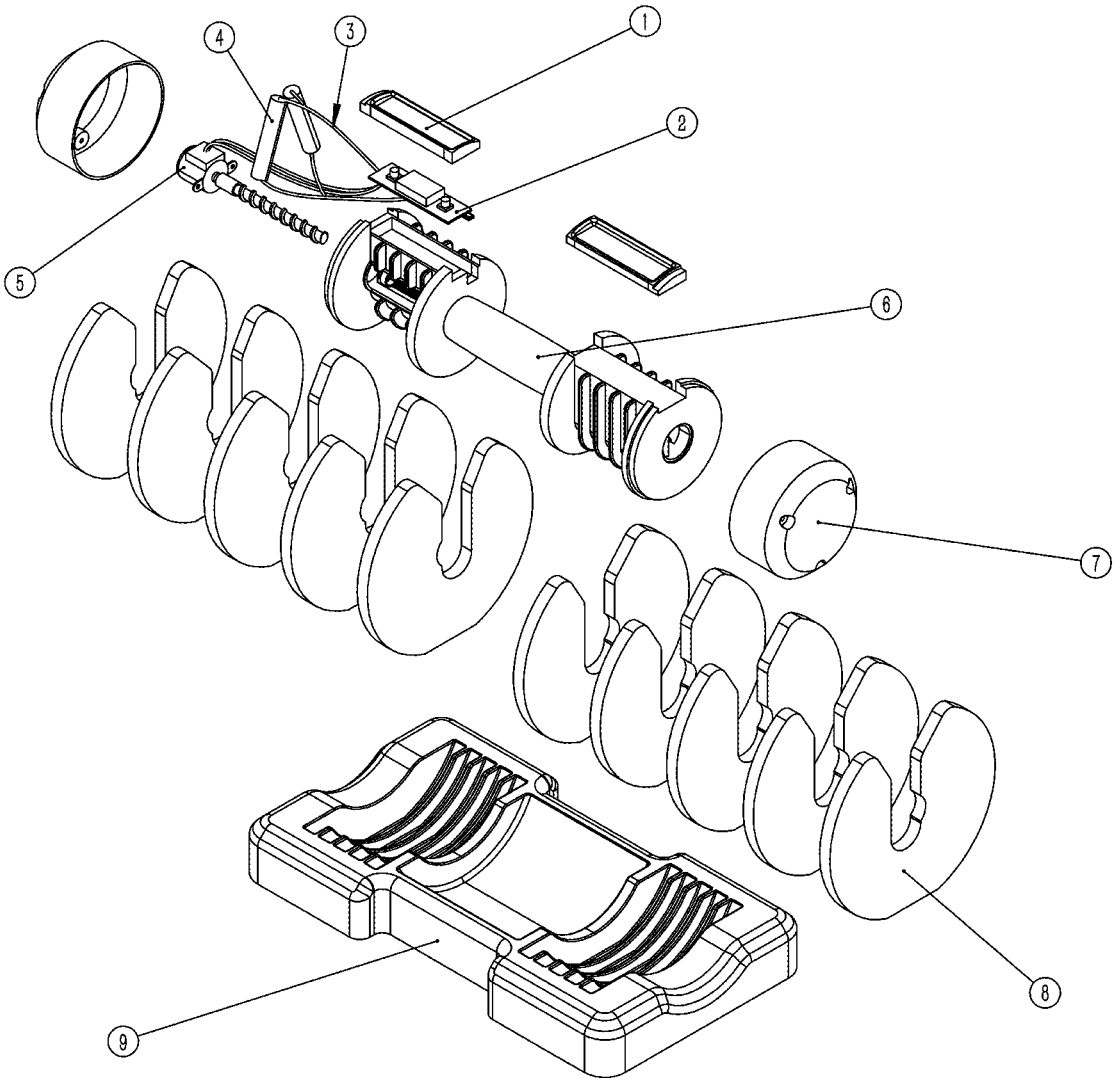
FIG. 2 is an exploded view of the handle grip of the invention.
Figure 3:
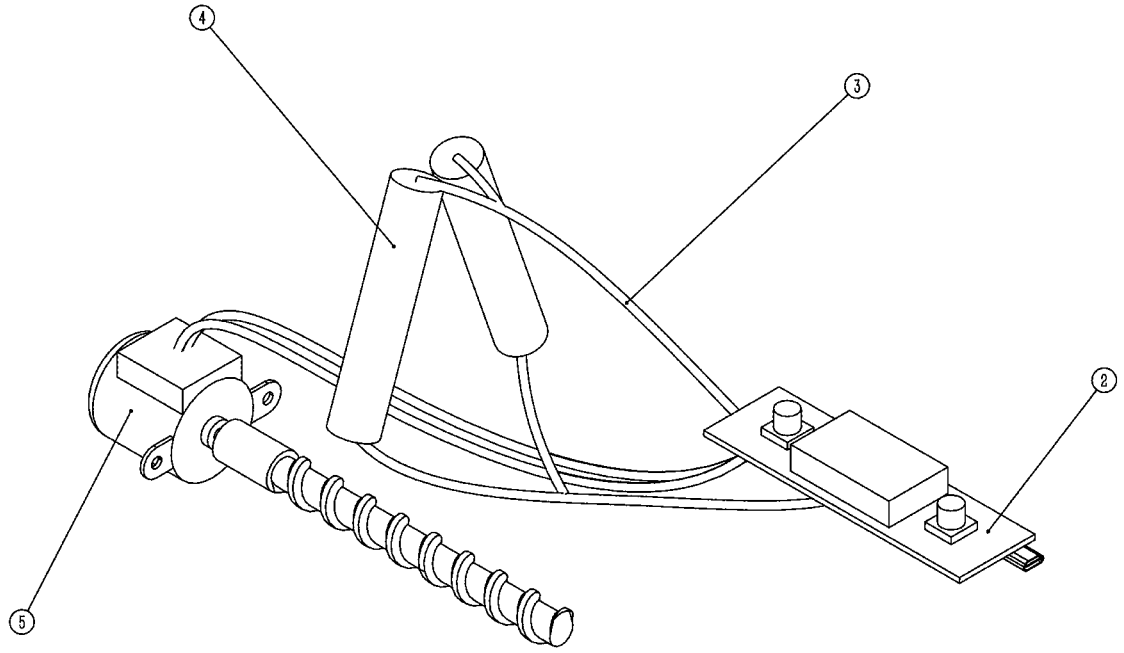
FIG. 3 is a perspective view of the motor assembly of the invention.

As shown in FIG. 2, ten weight plates (8) are evenly positioned at the front and the back side of the bottom of handle grip (6).

As shown in FIG. 2, both the front and back side on the top of the base (9) are provided with storage slots for the weight plates (8), and the top of base (9) is provided with clearance slots which are located inside the storage slots and used in conjunction with the handle grip (6).

As shown in FIG. 2, an electronic screen (1) is installed on the rear side of the top of handle grip (6).

As shown in FIG. 2, the motor assembly (5) can be detached through screws and connected to the front and back of the handle grip (6), and the end cover (7) is designed with a curved surface.

Working principle and use of the invention: when using the dumbbell, the user turns on the button switch (10) on the surface of electronic screen (1). The button switch (10) controls the rotation of the motor assembly (5) through the main board (2), and the motor assembly (5) drives the first locking bar (14) which drives the second locking bar (16) through the rotating shaft (15), thereby simultaneously locking the weight stack (8) from the front and the back side of the handle grip (6) for weight plate adjustment. The weight plates can be adjusted by pressing the button switch 10. The replacement of traditional manual adjustment by electric control obviates the complicated steps required for manual adjustment. The operation is so simple that the first-time user can complete the operation electronically.

In conclusion, the invention provides a handle grip (6), the weight stack (8), a base (9), an end cover (7), an electronic control system and a weight stack locking structure, and solves the existing problems of adjustable dumbbells as follows: firstly, the operation is so complicated and cumbersome that it is quite difficult to adjust the weight in one try, and the novice who is new to the adjustable dumbbells cannot quickly adjust the weight plates, resulting in wrong operation and unsuccessful weight plate adjustment, and even causing damage to the product in some cases and inconvenience to the users; secondly, visually the product looks too complicated since the number that needs to be adjusted is printed on the cylindrical surface, and half of the numbers on the handle surface are located below the handle grip, which is difficult to see by the user; thirdly, the lack of modernity and inadequate aesthetics hinders product sales, making it difficult to make profit quickly.

It should be noted that in this article, relational terms such as the first and second are only used to distinguish an object or operation from another one, and do not necessarily require or imply any such actual relationship or order between these objects or operations. Moreover, the terms "include", "comprise" or any other variants thereof are intended to cover non-exclusive inclusion, so that a process, method, article, or device including a series of elements not only includes those elements, but also the elements that are not explicitly listed, or those inherent to the process, method, article, or equipment.

Although the embodiments of the invention have been shown and described, those of ordinary skill in the art can understand that changes, modifications, and substitutions can be made to these embodiments without departing from the principle and design of the invention, and the scope of the invention is defined by the appended claims and their equivalents.

What is claimed is:

1. An electronically controlled adjustable dumbbell comprising a handle grip (6), a weight stack (8), a base (9), an end cover (7), an electronic control system and a weight stack locking structure, wherein:

the weight stack (8) is located below the handle grip (6), the base (9) is located at the bottom of the weight stack (8), the end cap (7) is fixed on a front and a back of the handle grip (6) by bolts, the electronic control system is positioned on the handle grip (6);

the electronic control system comprises an electronic screen (1), a main board (2), wires (3), a battery (4) and a motor assembly (5), wherein the main board (2) is fixed to a rear side on the top of the handle grip (6), the electronic screen (1) positioned on the top of the main board (2) is electrically connected to the main board (2) through the wires, one end of one of the wires (3) is fixed to the main board (2), and the other end connected to the battery (4), the motor assembly (5) is electrically connected to the main board (2) through the wires, and the electronic control system is connected to the weight stack locking structure, and the weight stack locking structure comprises a first locking bar (14), a rotating shaft (15), a second locking bar (16), a weight plate clamping block (13), and a weight plate spacer (12), wherein the first locking bar (14), the rotating shaft (15), the second locking bar (16), the weight plate clamping block (13), and the weight plate spacer (12) are all located inside the handle grip (6), the first locking bar (14) and the second locking bar (16) are powered by the rotating shaft (15).

2. The electronically controlled adjustable dumbbell according to claim 1, wherein a front side and a back side of the top of the electronic screen (1) are provided with a button switch (10).

3. The electronically controlled adjustable dumbbell according to claim 1, wherein the front of the main board (2) is connected with a charging port (11).

4. The electronically controlled adjustable dumbbell according to claim 1, wherein the surface of the first locking bar (14) is provided with a spiral groove for the motor assembly that works in conjunction with the rotating shaft (15) and the second locking bar (16).

5. The electronically controlled adjustable dumbbell according to claim 1, wherein the motor assembly (5) rotates with the first locking bar (14), and is connected with the weight stack locking structure for transmission.

6. The electronically controlled adjustable dumbbell according to claim 1, wherein ten weight plates (8) are evenly positioned at the front and the back side of the bottom of the handle grip (6).

7. The electronically controlled adjustable dumbbell according to claim 1, wherein both a front side and a back side on the top of the base (9) are provided with storage slots for the weight plates (8), and the top of base (9) is provided with clearance slots which are located inside the storage slots and used in conjunction with the handle grip (6).

8. The electronically controlled adjustable dumbbell according to claim 1, wherein the electronic screen (1) is installed on the rear side of the top of handle grip (6).

9. The electronically controlled adjustable dumbbell according to claim 1, wherein the motor assembly (5) can be detached through screws and connected to the front and back of the handle grip (6), and the end cover (7) is designed with a curved surface.

* * * * *